US006789852B1

(12) United States Patent
Huang

(10) Patent No.: US 6,789,852 B1
(45) Date of Patent: Sep. 14, 2004

(54) ADJUSTABLE FOOTREST OF A RECLINING CHAIR

(76) Inventor: Chi-Tzung Huang, No. 20, Industry 3rd Rd., Hsing Nan Vill., Min Hsiung, Chia Yi Hsien (TW)

( * ) Notice: Subject to any disclaimer, the term of this patent is extended or adjusted under 35 U.S.C. 154(b) by 0 days.

(21) Appl. No.: 10/747,357

(22) Filed: Dec. 30, 2003

(51) Int. Cl.[7] ..... A47C 7/50
(52) U.S. Cl. ..... 297/423.32; 5/618
(58) Field of Search ..... 297/423.3, 423.31, 297/423.32, 69; 5/618, 624

(56) References Cited

U.S. PATENT DOCUMENTS

RE10,906 E * 3/1888 Case ..... 297/69
597,278 A * 1/1898 Fischer et al. ..... 297/423.32
1,310,581 A * 7/1919 Russo ..... 297/423.32
2,617,469 A * 11/1952 Skok ..... 297/423.3
2,696,868 A * 12/1954 Miller ..... 297/69
3,177,503 A * 4/1965 Black et al. ..... 5/618
3,282,605 A * 11/1966 Nihlean et al. ..... 297/423.35
5,918,942 A * 7/1999 Olsen ..... 297/423.32

* cited by examiner

*Primary Examiner*—Peter R. Brown
(74) *Attorney, Agent, or Firm*—Rosenberg, Klein & Lee

(57) ABSTRACT

A footrest of a reclining chair has a footrest part pivoted to the seat, and an adjusting mechanism joined to the frame of the chair and the footrest part; the adjusting mechanism has a pivotal shaft supported on the frame, first and second controls in the form of a pedal connected with one end of the shaft, connecting rods pivoted to the footrest part and joined to the shaft, and a stopping member connected with the other end of the shaft for helping hold the footrest part in position; the first and the second controls are connected with the shaft such that the footrest part can be angularly displaced to, and secured in a stretched position by depressing the pedal portion of the first control, and such that the footrest part can be moved towards a retreated position by depressing the second control to angularly displace same.

6 Claims, 12 Drawing Sheets

ADJUSTABLE FOOTREST OF A RECLINING CHAIR

BACKGROUND OF THE INVENTION

1. Field of the invention

The present invention relates to an adjusting mechanism for a footrest of a reclining chair, more particularly one, with which the footrest can be moved to, and securely held in a selected one of various positions to suit the sitter's need, and which is easy to operate.

2. Brief Description of the Prior Art

There are reclining chairs of such kind that can be adjusted in the position of the seats and backs, and can be folded for easy storage. Among all conventional adjustable reclining chairs, there are a kind of very common chairs, which are made such that when one wants to adjust the seats or backs thereof, he needs to first sit on the chairs, unlock the seats or backs, and then move the same to the intended position with his body, when the user doesn't need to use the chairs, he can move the back to the original upright position. However, most reclining chairs of that kind are not equipped with footrests, and the sitter has to place an ottoman in front of the reclining chair, and rest his feet on the ottoman. Therefore, the reclining chairs are not very convenient to use.

To overcome the above disadvantage, rails are disposed under the seat of a reclining chair, and an U-shaped metallic tube is movably fitted to the rails such that the sitter can make the U-shaped metallic tube project from the seat for resting his feet on. However, the U-shaped tube is prone to fall out of the rails because in order for allowing the tube to slide along the rails with ease, the connection between the tube and the rails is not tight. In addition, the sitter is likely to have sore and aching feet soon because the U-shaped tube doesn't have large enough area, which is the only object that the sitter feet are rested on.

Referring to FIG. 11, a conventional reclining chair 1 for patient and people receiving rehabilitation service includes an adjustable seat 11, a frame 13, and a footrest 12. The footrest 12 is comprised of a foot supporting part 121, and a control mechanism, which includes a crank 122, a pivotal shaft 123, a control pedal 124, and an auxiliary positioning apparatus 125; the foot supporting part 121 is pivoted to a front portion of the seat 11, and can be covered with the cushion used on the seat 11 or equipped with transverse elastic straps for the sitter to rest his feet on comfortably; the crank 122 includes several connecting rods, and is pivoted to the foot supporting part 121 at one end; the pivotal shaft 123 is fitted to a lower portion of one lateral part of the frame 13, and joined to the other end of the crank 122; the control pedal 124 is arranged opposite an outward side of the frame 13, and securely joined to the pivotal shaft 123. The auxiliary positioning apparatus 125 includes first and second moving rods, and a main body, which is equipped with elastic element (not shown), and which is connected to the first moving rod; one of the connecting rods of the crank 122 is pivoted to the main body of the positioning apparatus 125 while the second moving rod is pivoted to the first moving rod and the frame 13 at two ends thereof. Thus, the foot supporting part 121 can be moved to a substantially upright no-in-use position by means of making the pivotal shaft 123 turn counterclockwise with the help of the control pedal 124, and can be moved to a stretched in-use position by means of making the pivotal shaft 123 turn clockwise. With the footrest 12, there is no need for one to place an ottoman in front of the seat 11.

However, the above reclining chair is found to have disadvantages as followings:

1. The foot supporting part 121 can only be held in the upright no-in-use position and the stretched in-use one, but cannot be adjusted in between for providing the sitter with more choices.
2. One has to depress one end of the control pedal 124 with enough strength so that the foot supporting part 121 can be moved from the no-in-use position to the stretched in-use position in one action, otherwise the part 121 won't be firmly held up, and he will have to operate the control pedal 124 again.
3. The control mechanism of the footrest 12 includes the crank 122 comprised of several connecting rods and pivoted to the foot supporting part 121 at one end, the pivotal shaft 123 joined to the other end of the crank 122, the control pedal 124, and the auxiliary positioning apparatus 125. Consequently, the control mechanism is complicated in the structure and expensive to manufacture.

SUMMARY OF THE INVENTION

It is a main object of the present invention to provide a footrest of a reclining chair to overcome the above disadvantages.

The footrest includes a footrest part pivoted to a front portion of the seat, and an adjusting mechanism for adjusting the footrest part with. The adjusting mechanism includes a pivotal shaft, two pairs of first and second connecting rods for passing on movement of the pivotal shaft to the footrest part, a third connecting rod, a detaining member, an engaging member, first and second elastic elements, first and second controls for displacing the footrest part with, and a stopping member for helping holding the footrest part in position after adjustment of the footrest part.

The pivotal shaft is supported with the frame. The first rods are securely joined to the pivotal shaft while the second rods are each pivoted to a corresponding first rod, and pivoted to the footrest at two ends. The footrest part is movable between a completely stretched position and a retreated one by means of causing rotation of the pivotal shaft to displace the first and the second rods. The third rod is pivoted on a first end of the pivotal shaft. The detaining member is secured to the frame with the first end of the pivotal shaft being passed through a hole thereof, and is formed with ratchet teeth. The engaging member is pivoted on the third rod for releasable engagement with the ratchet teeth. The engaging member has an engaging portion, and a rod-shaped pressed portion. The first elastic element is joined to the third rod, and the engaging portion of the engaging member at two ends thereof for making the engaging member biased to such a position as to engage the detaining member. The first control includes a pedal portion and a flat portion, and is angularly displaceable together with the shaft. The flat portion has a pivotal hole, and two posts located apart. The second control has an elongated flat portion positioned between the detaining member and the first control plus between the posts of the first control. The elongated flat portion has an up-facing notch. The second control is pivoted to the pivotal hole of the first control. The second elastic element is joined to the flat portion of the first control, and the second control member for biasing the second control in such a way that the notch is away from the pressed portion of the engaging member. The teeth of the detaining member are in such a direction that the engaging member won't engage the teeth when the first control is being depressed to turn. The edge of the notch of the second control will be pressed against the pressed portion of the engaging member to make the engaging member disengage the ratchet teeth when the second control is being depressed to turn. The stopping member is joined to the second end of the pivotal shaft, and includes a fixed plate securely joined to the pivotal shaft, a ratchet positioned next to the fixed plate and angularly displaceable on the pivotal shaft, an engaging bar pivoted to the frame for engagement with the ratchet, an elastic element joined to the frame and the bar at two ends thereof for biasing the engaging bar to an engaging position where the bar engages the ratchet, a lining next to the ratchet, a separating plate next to the lining and rotary together with the pivotal shaft, a nut screwed onto the shaft, and a spring for making the lining and the ratchet closely sandwiched between the fixed plate and the separating plate.

BRIEF DESCRIPTION OF THE DRAWINGS

The present invention will be better understood by referring to the accompanying drawings, wherein:

FIG. 2-1 is another partial exploded perspective view of the adjustable footrest according to the present invention, FIG. 5-1 is a cross-sectional view of a part of the present adjustable footrest that is shown in FIG. 5.

DETAILED DESCRIPTION OF THE PREFERRED EMBODIMENTS

Figure 1:
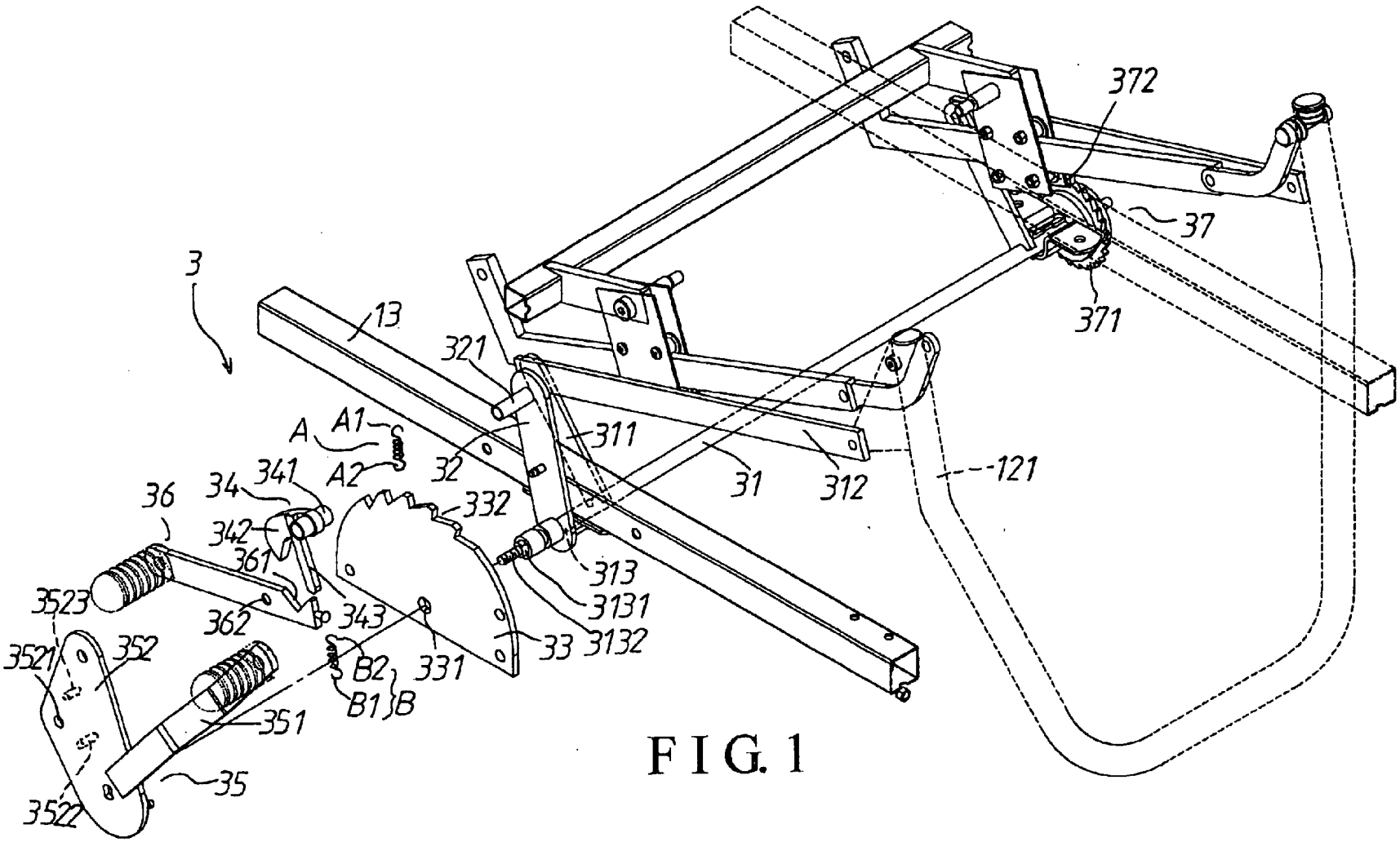
FIG. 1 is a partial exploded perspective view of the adjustable footrest of a reclining chair according to the present invention.
Figure 2:
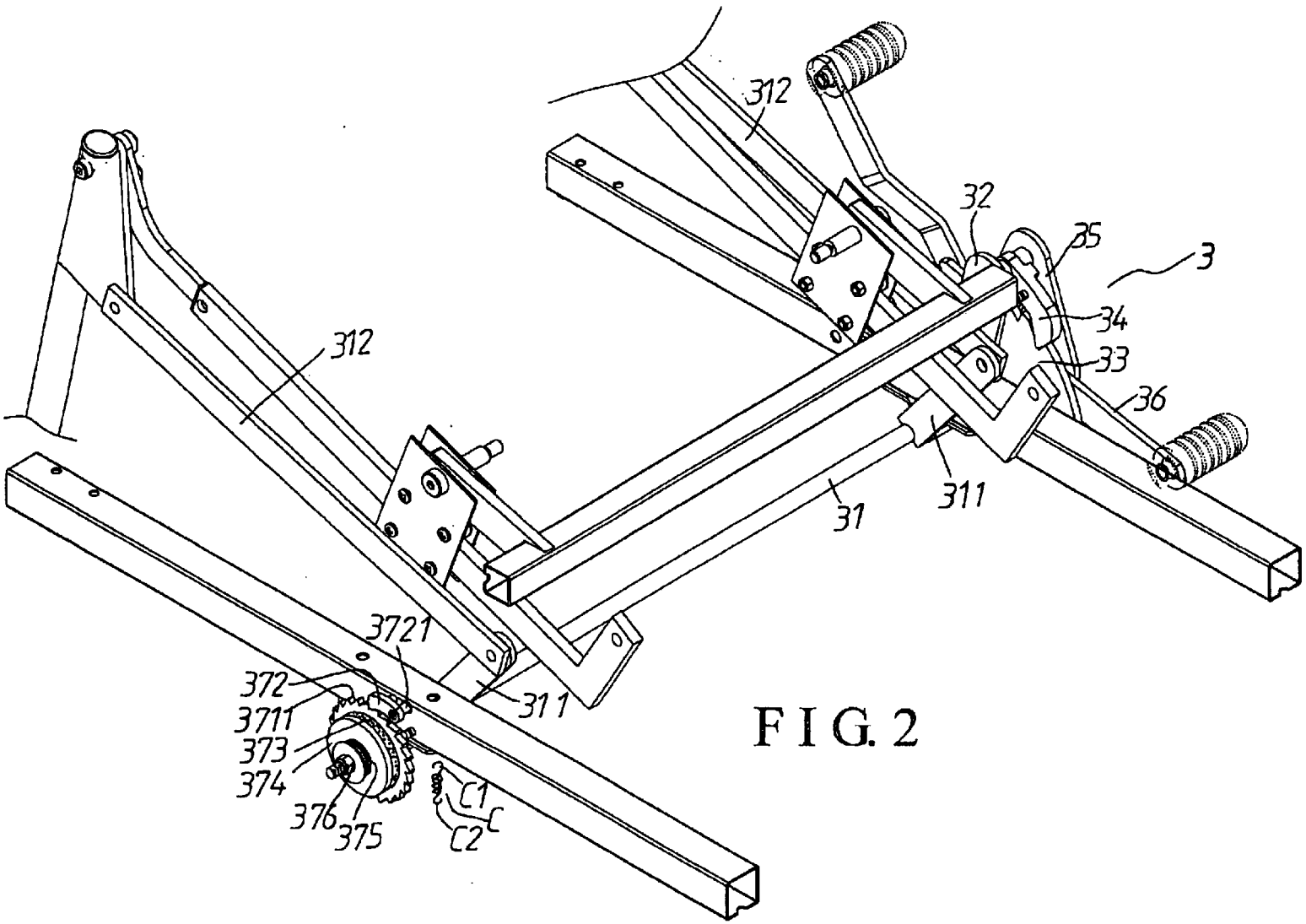
FIG. 2 is a partial perspective view of the adjustable footrest of a reclining chair according to the present invention.
Figures 1, 2:
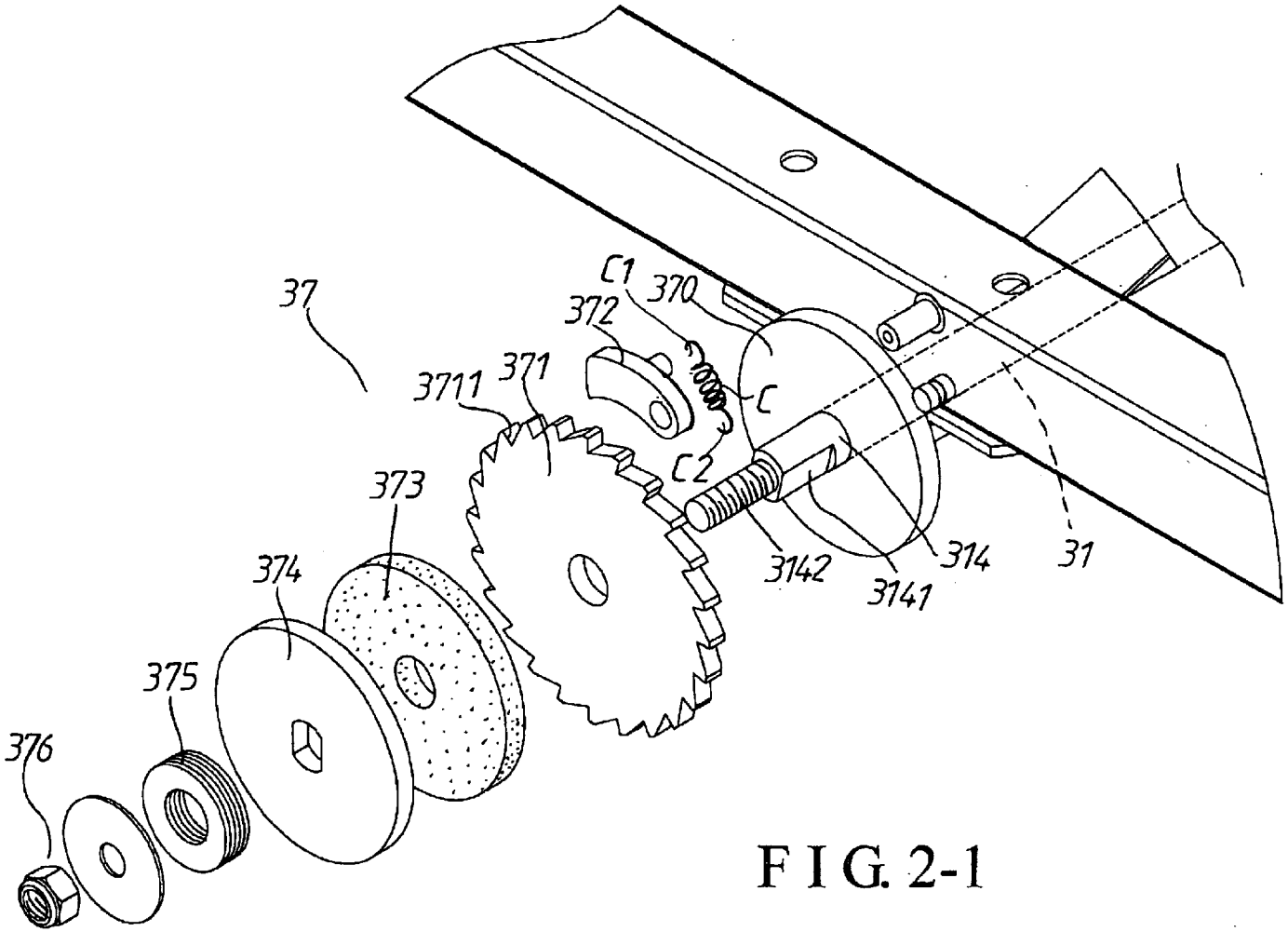
Figure 3:
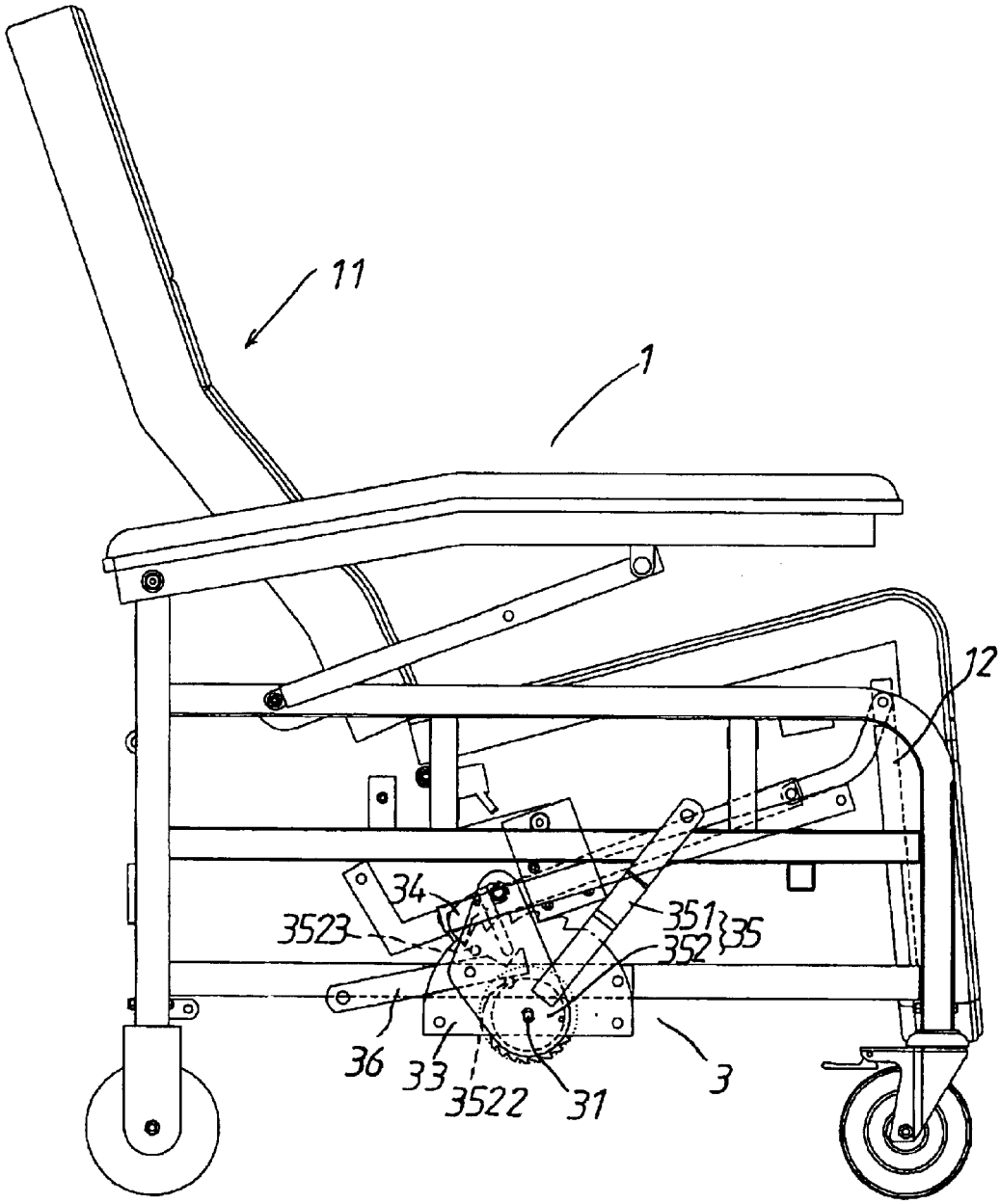
FIG. 3 is a side view of the reclining chair according to the present invention.
Figure 5:
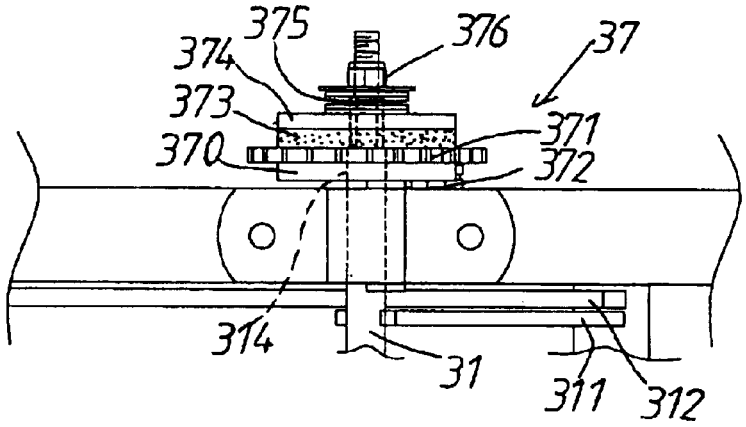
FIG. 5 is another partial bottom view of the adjustable footrest according to the present invention.
Figure 4:
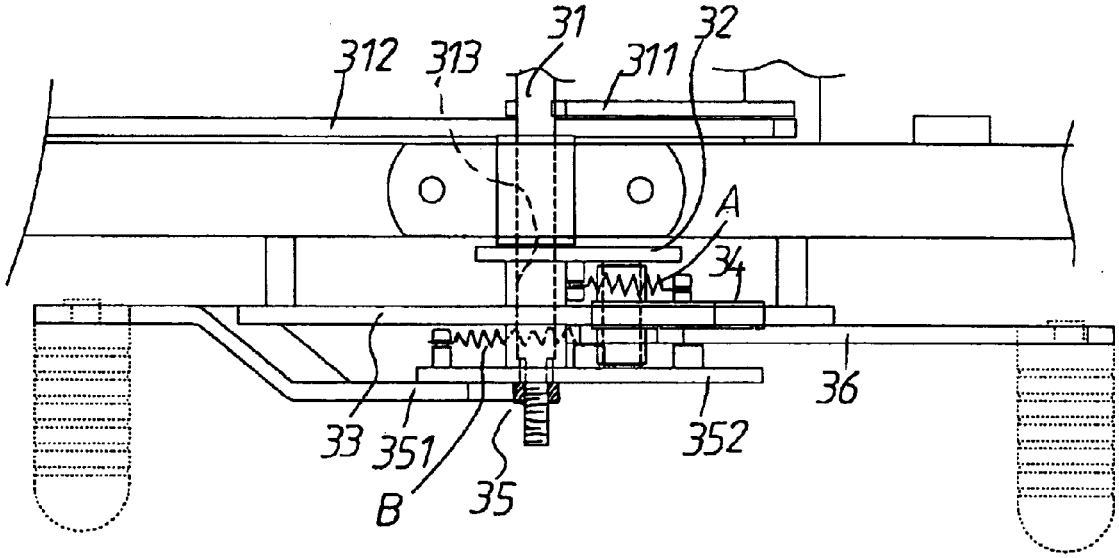
FIG. 4 is a partial bottom view of the adjustable footrest according to the present invention.
Figures 1, 5:
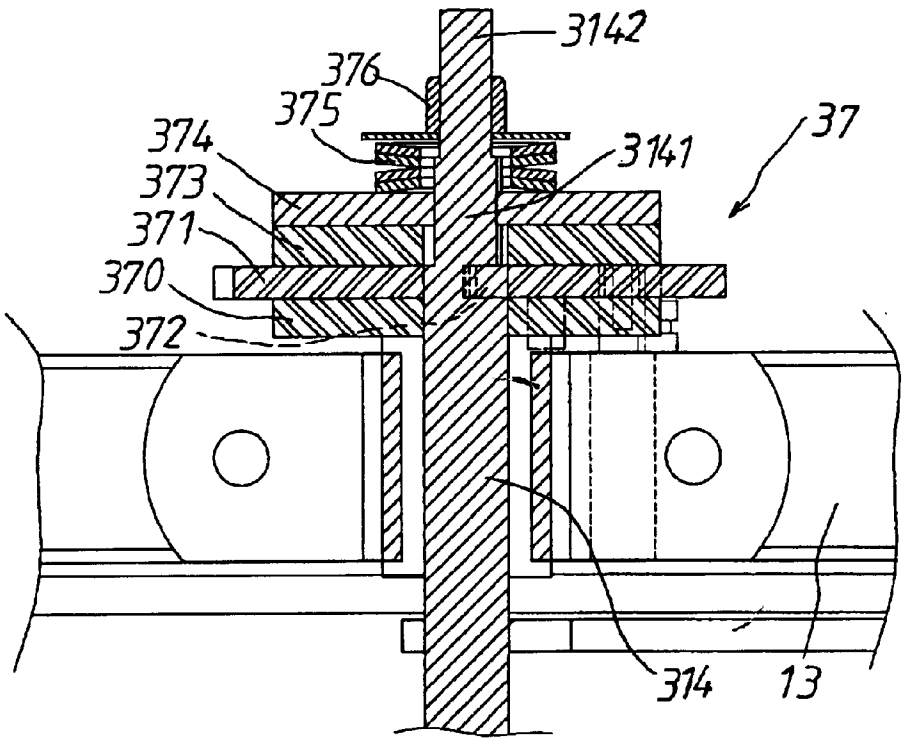
Figure 6:
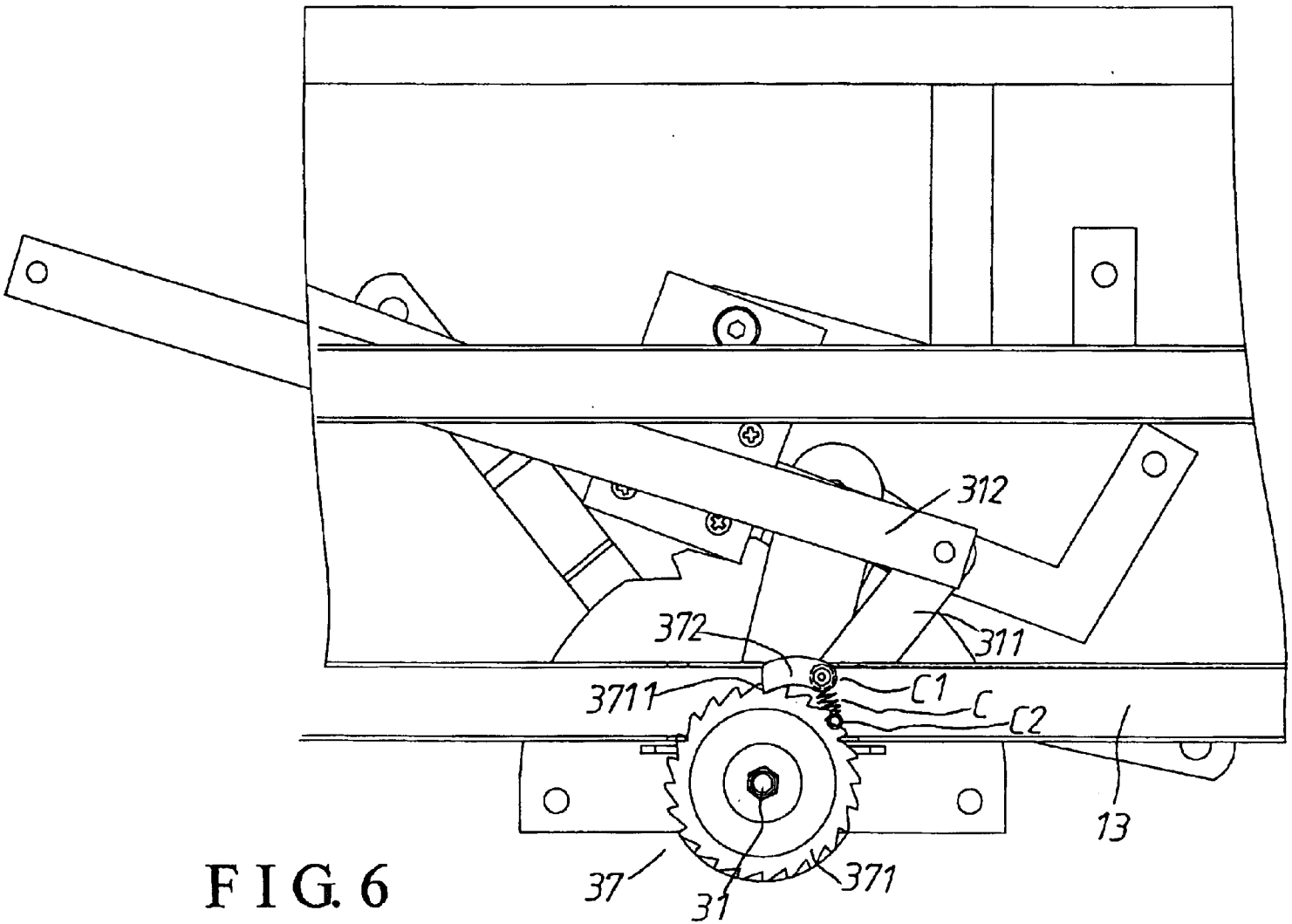
FIG. 6 is a side view of a part of the present adjustable footrest that is shown in FIGS. 2-1 and 5.

Referring to FIGS. 1, 2, 2-1, and 3, a preferred embodiment of an adjusting mechanism 3 for a footrest 121 of a reclining chair 1 is provided in the present invention; the footrest 121 is pivoted to a front portion of a seat of the chair 1 while the adjusting mechanism 3 is joined to a frame 13 of the chair 1, on which the seat is supported; the adjusting mechanism 3 includes:

a pivotal shaft 31 passed through first and second lateral portions of a lower part of the frame 13 respectively at first and second ends 313 and 314 thereof; the first and the second ends 313, 314 of the shaft 31 are formed with a non-cylindrical fitting section 3131, 3141, and a threaded connecting section 3132, 3142 adjacent to the fitting section 3131, 3141;

two first connecting rods 311 and two second connecting rods 312 for passing on movement of the pivotal shaft 31 to the footrest 121; the first connecting rods 311 are securely joined to the pivotal shaft 31 while the second connecting rods 312 are pivoted to a respective one of the first connecting rods 311, and pivoted to the footrest 121;

a third connecting rod 32 pivoted on the first end 313 of the shaft 31 at a first end thereof; the third connecting rod 32 has a pivotal post 321 on an outward side thereof, and a locating post (not numbered) under the pivotal post 321 on the outward side;

a detaining member 33 secured to an outward side of the first lateral portion of the frame 13 with the first end 313 of the shaft 31 being passed through a through hole 331 thereof; the detaining member 33 is formed with several ratchet teeth 332, each of which has a sloping side and a steep side; the ratchet teeth 332 of the detaining member 33 are in such a direction as to be only capable of preventing the engaging member 34 from being rewards displaced if the engaging member 34 has not been first disengaged from the detaining member 33;

an engaging member 34 positioned around and pivoted to the post 321 of the third rod 32 at a tube portion 341 thereof for releasable engagement with the detaining member 33; the engaging member 34 further has an engaging portion 342, and an elongated rod-shaped pressed portion 343;

a first elastic element A joined to the locating post of the third rod 32, and the engaging portion 342 of the engaging member 34 respectively at first and second ends A1 and A2 thereof for making the engaging member 34 biased to such a position as to engage the ratchet teeth 332 of the detaining member 33;

a first control member 35 including a pedal portion 351, and a flat positioning portion 352 securely joined to the pedal portion 351; the positioning portion 352 is positioned opposite the outward side of the detaining member 33 with a fitting hole (not numbered) thereof being fitted around the non-cylindrical section 3131 of the first end 313 of the shaft 31; the positioning portion 352 further has a pivotal hole 3521, and two stopping posts 3522, 3523 a suitable distance apart on the inward side thereof;

a second control member 36 made in the form of a pedal; the second control member 36 has an elongated flat portion, which is positioned between the detaining member 33 and the first control member 35, and which is formed with an upfacing notch 361, a locating protrusion (not numbered) at a tail end, and a pivotal portion 362; the second control member 36 is pivoted to the pivotal hole 3521 of the first control member 35 at the pivotal portion 362 thereof such that the elongated flat portion thereof is arranged between the stopping posts 3523 and 3522 of the first control member 35;

a second elastic element (B) respectively joined to the flat positioning portion 352 of the control member 35, and the locating post of the control member 36 at lower and upper ends B1 and B 2 thereof for biasing the second control member 36 such that the up-facing notch 361 is normally away from the rod-shaped pressed portion 343 of the engaging member 34; and a stopping member 37 connected to the second end 314 of the pivotal shaft 31 for helping hold the footrest 121 in position after adjustment of the footrest 121, as shown in FIGS. 2 and 2-1; the stopping member 37 includes a fixed plate 370 securely joined to the shaft 31, a ratchet 371 positioned next to the fixed plate 370 and around the shaft 31, an engaging bar 372 pivoted to the frame 13 for engagement with the ratchet 371, a lining 373 next to the ratchet 371, a separating plate 374 positioned next to the lining 373, an elastic element 375 positioned around the shaft 31, and an adjusting nut 376 screwed onto the threaded section 3142 of the shaft 31 for making the lining 373 and the ratchet 371 closely sandwiched between the separating plate 374 and the fixed plate 370; the ratchet 371 is angularly displaceable relative to the shaft 31, and has ratchet teeth 3711, each of which has a sloping side and a steep side; the teeth 3711 of the ratchet 371 is such a direction as to be capable of engaging the engaging bar 372 only when the lining and the separating plate 374 are counterclockwise turned; in other words, the teeth 3711 of the ratchet 371 are in a direction opposite to that of the ratchet teeth 332 of the detaining member 33; the separating plate 374 is fitted around the non-cylindrical section 3141 of the shaft 31 such that it will turn together with the shaft 31; an elastic element C is joined to the frame 13 and the engaging bar 372 at two ends C1 and C2 for making the bar 372 move down to engage the ratchet 317.

Figure 7:
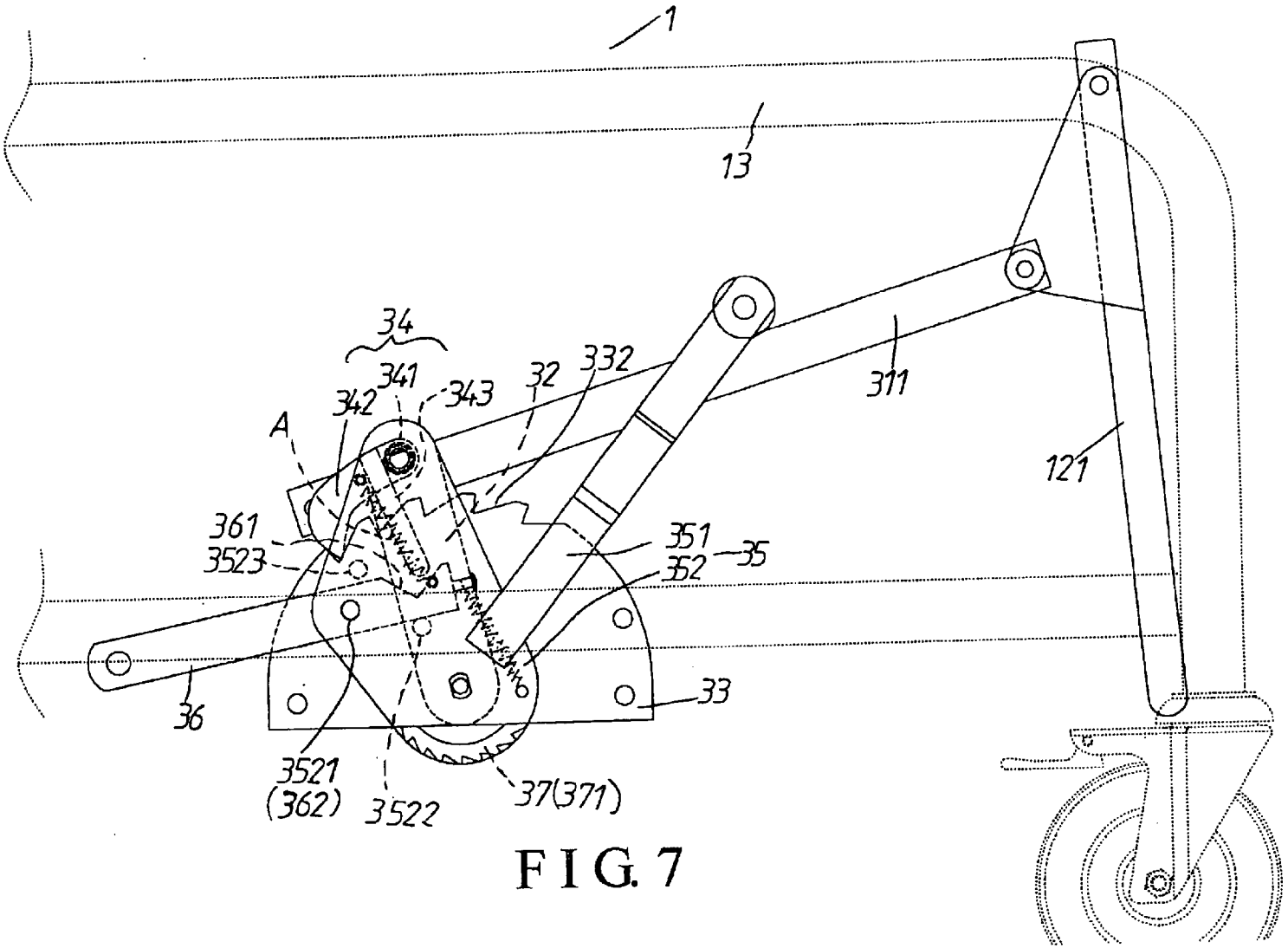
FIG. 7 is a side view of the present adjustable footrest in the retreated not-in-use position.
Figure 8:
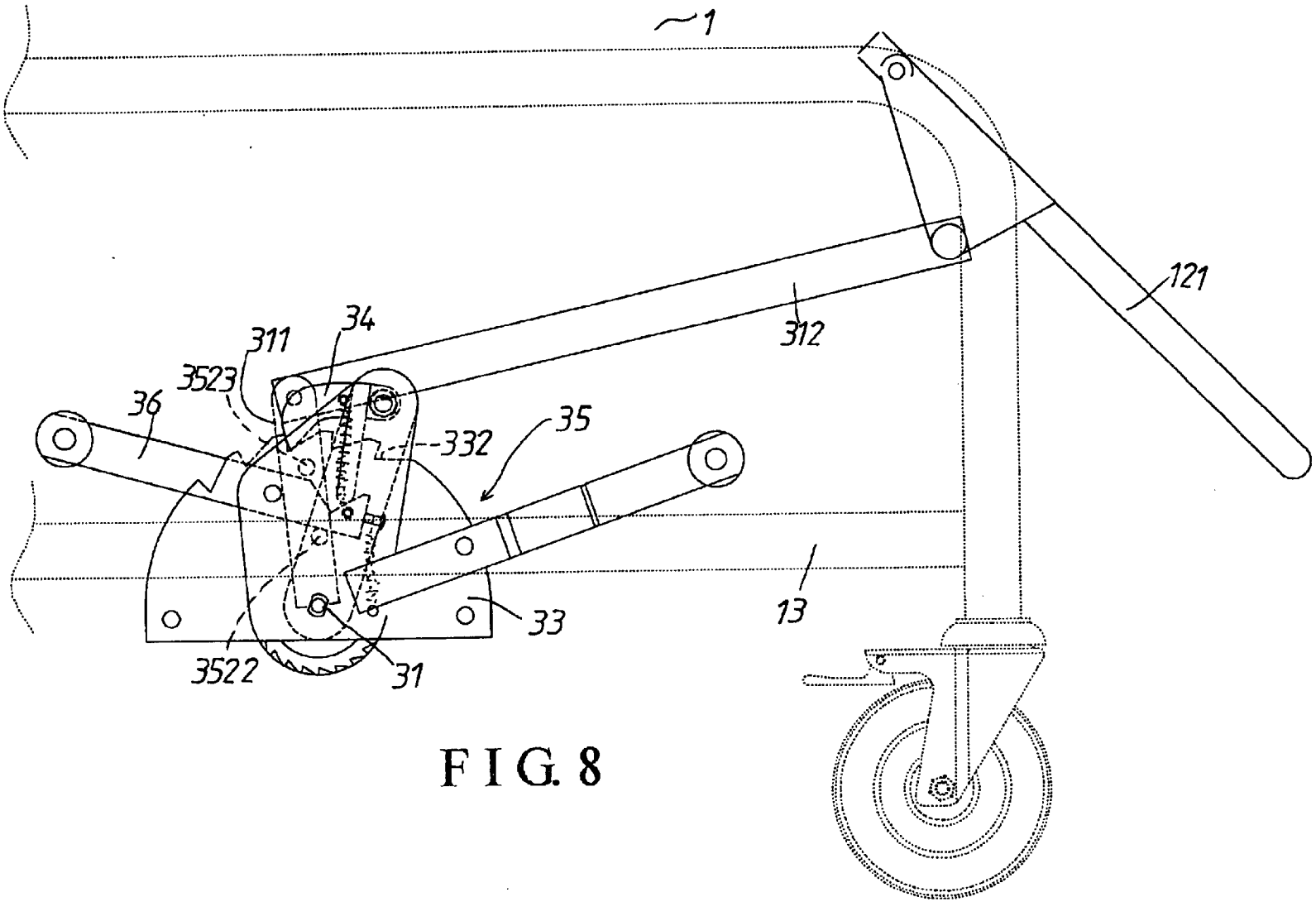
FIG. 8 is a side view of the present adjustable footrest in one in-use position between the retreated position and the completely stretched one.
Figure 9:
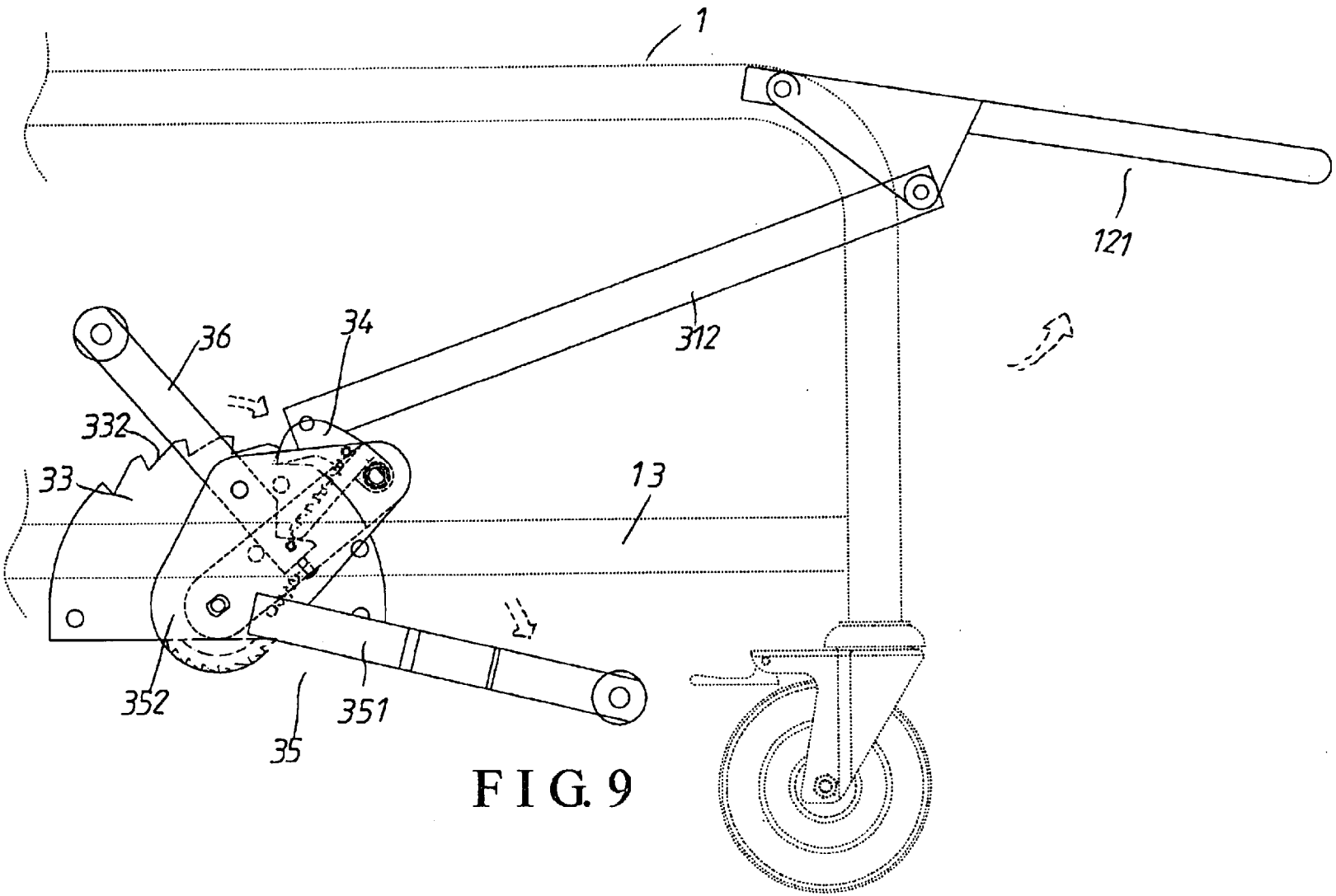
FIG. 9 is a side view of the present adjustable footrest in the completely stretched in-use position.
Figure 10:
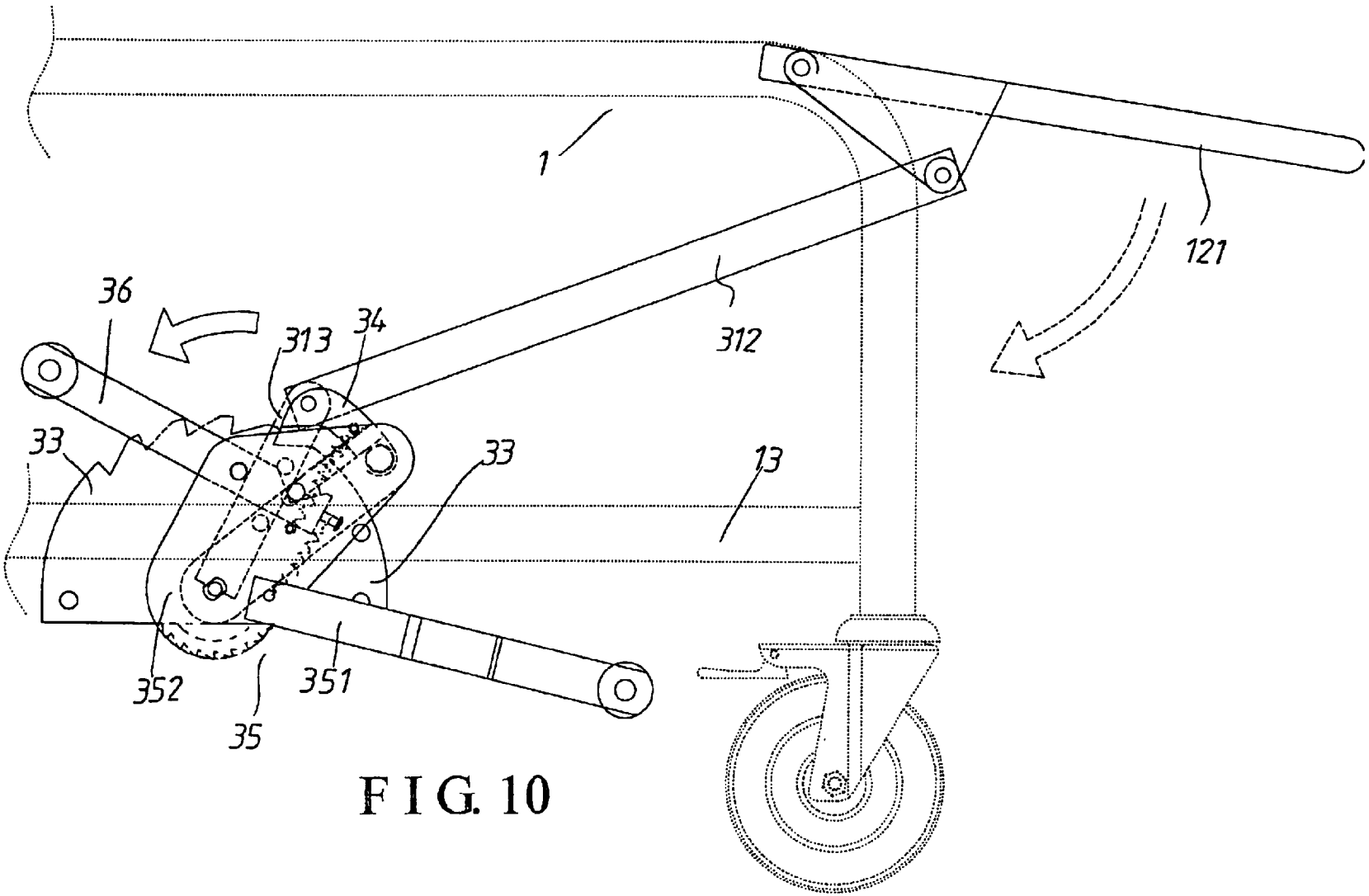
FIG. 10 is a side view of the present adjustable footrest under adjustment.
Figure 11:
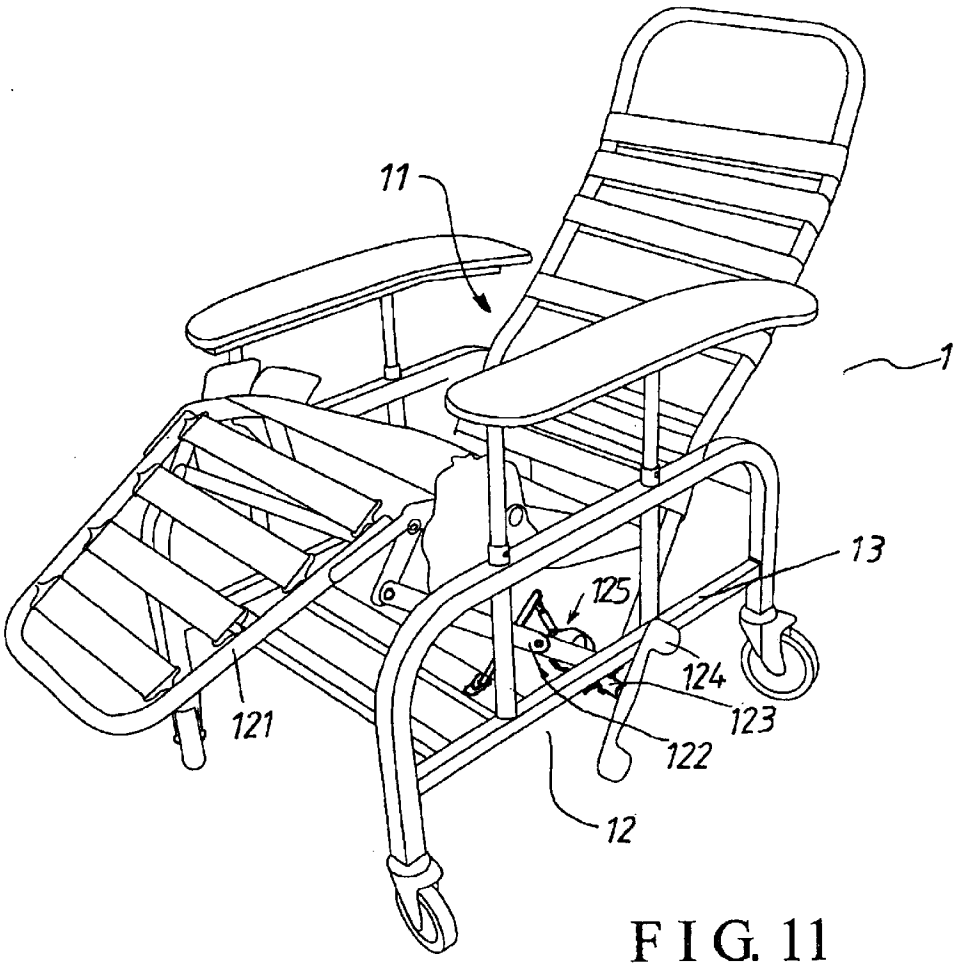
FIG. 11 (PRIOR ART)
FIG. 11 is a perspective view of the conventional reclining chair as described in the Background.

The footrest 121 will be in a retreated not-in-use position when the engaging member 34 is engaged with a rearmost one of the ratchet teeth 332 of the detaining member 33, as shown in FIG. 7, and will be in a completely stretched position when the engaging member 34 is engaged with a front one of the ratchet teeth 332, as shown in FIG. 10. Referring to FIGS. 8 and 9, to move the footrest 121 to a stretched position for use, the pedal portion 351 of the control member 35 is depressed; thus, both the pivotal shaft 31 and the third connecting rod 32 turn clockwise, the engaging member 34 moves together with the third connecting rod 32, and the first and the second connecting rods 311 and 312 made to prop up the footrest 121; in moving in this direction (forward), the engaging member 34 won't be stopped by the ratchet teeth 332 of the detaining member 33; the elastic element A will make the engaging member 34 engage one of the teeth 332 as soon as the user stops depressing the first control member 35, and in turns, the footrest 121 is prevented from moving back to the retreated not-in-use position due to gravity or the weight of the sitter's legs; because the direction of the ratchet teeth 3711 of the ratchet 371 are opposite to that of the teeth 332 as mentioned above, the engaging bar 372 will also engage the ratchet 371 to help prevent the footrest 121 from moving back to the retreated position due to gravity or the weight of the sitter's legs after stretching the footrest 121. Therefore, the footrest 121 can be moved to and held up in a selected one of several different stretched positions by means of operating the first control member 35.

Referring to FIG. 10, to move the footrest 121 towards the completely retreated position to adjust the same, the second control member 36 is depressed at a pedal portion; thus, the elongated flat portion of the second control member 36 is angularly displaced on the pivotal portion 362, and pressed against the stopping post 3523, and in turns, the edge of the notch 361 is pressed against the elongated rod-shaped pressed portion 343 of the engaging member 34 to make the engaging portion 342 disengage the ratchet teeth 332, and the first control member 35 as well as the pivotal shaft 31 are angularly displaced accordingly (counterclockwise). Consequently, the first and the second connecting rods 311 and 312 are moved together with the pivotal shaft 31, and make the footrest 121 retreat; the elastic element A will make the engaging member 34 move back into engagement with the ratchet teeth 332 as soon as the user stops depressing the second control member 36.

When the footrest 121 is being moved in the stretching direction by means of operating the control member 35, the ratchet 371 will turn together with the shaft 31 and the separating plate 374, in such a direction, wherein it is not engaged with the engaging bar 372, because it and the lining 373 are closely sandwiched between the separating plate 374 and the fixed plate 370. And, the footrest 121 will be prevented from moving back due to gravity or the weight of the sitter's legs with the help of the engagement of both the engaging bar 372 and the ratchet 371 as soon as the user stops depressing the control member 35.

Furthermore, when the footrest 121 is being moved towards the completely retreated position by means of operating the control member 36, the ratchet 371 will be stopped by the engaging bar 372, and won't turn counterclockwise together with the shaft 31 and the separating plate 374. Because the ratchet 371 and the lining 373 are closely sandwiched between the separating plate 374 and the fixed plate 370, the pivotal shaft 31 will be slowed down in turning counterclockwise, and in turns, the footrest 121 will be slowly moved when it-is being moved back from a stretched position towards the retreated no-in-use one. And, friction between the lining 373 and the ratchet 371 can be adjusted by means of hanging the position of the adjusting nut 376.

From the above description, it can be easily understood that the adjusting mechanism of a reclining chair in the present invention has advantages as followings:

1. With the adjusting mechanism, the footrest of the reclining chair can be adjusted between the completely stretched position and the retreated one for suiting various situations.
2. With the adjusting mechanism, the footrest can be firmly held in position after it is adjusted. Consequently, the footrest is safe to use.
3. The adjusting mechanism has uncomplicated structure.

What is claimed is:

1. A footrest of a reclining chair, comprising a footrest part pivoted to a front portion of a seat of a reclining chair; and an adjusting mechanism joined to a frame of the chair, on which the seat is supported; the adjusting mechanism including:

a pivotal shaft passed through first and second lateral portions of a lower part of the frame respectively at first and second ends thereof;

two pairs of first and second connecting rods used for passing on movement of the pivotal shaft to the footrest part; the first rods being securely joined to the pivotal shaft; the second rods being each pivoted to a corresponding first rod, and pivoted to the footrest at two ends; the footrest part being movable between a completely stretched position and a retreated one by means of causing rotation of the pivotal shaft to displace the first and the second connecting rods;

a third connecting rod pivoted on a first end of the pivotal shaft;

a detaining member secured to the first lateral portion of the frame with the first end of the pivotal shaft being passed through a hole thereof; the detaining member having a plurality of ratchet teeth on an edge;

an engaging member pivoted on the third rod for releasable engagement with the ratchet teeth of the detaining member; the engaging member having an engaging portion, and a rod-shaped pressed portion;

a first elastic element joined to the third rod, and the engaging portion of the engaging member at two ends thereof for making the engaging member biased to such a position as to engage the detaining member;

a first control for displacing the footrest part with; the first control including a pedal portion, and a flat portion securely joined to the pedal portion; the flat portion being joined to the first end of the pivotal shaft such that the first control is angularly displaceable together with the pivotal shaft; the flat portion having a pivotal hole thereon, and two stopping posts located apart on an inward side thereof;

a second control made in a form of a pedal for displacing the footrest part with; the second control having an elongated flat portion positioned between the detaining member and the first control plus between the stopping posts of the first control; the elongated flat portion having an up-facing notch, and a pivotal portion; the second control being pivoted to the pivotal hole of the first control at the pivotal portion thereof; and a second elastic element joined to the flat portion of the first control, and the second control member at two ends thereof for biasing the second control in such a way that the up-facing notch is away from the rod-shaped pressed portion of the engaging member;

the ratchet teeth of the detaining member being in such a direction that the engaging member won't engage them when the pedal portion of the first control is being depressed; an edge of the notch of the second control being going to be pressed against the rod-shaped pressed portion of the engaging member to make the engaging member disengage the ratchet teeth when the second control is being depressed, and angularly displaced;

thus allowing the footrest part to be angularly displaced to, and secured in a stretched position by means of depressing the pedal portion of the first control, and allowing the footrest part to be retreated from a stretched position by means of depressing the second control to angularly displace same.

2. The footrest as claimed in claim 1, wherein each of the ratchet teeth of the detaining member has a steep side and a sloping side.

3. The footrest as claimed in claim 1, wherein the third connecting rod has a pivotal post located thereon, and the engaging member has a tube portion projecting from it; the tube portion being fitted around the pivotal post for pivoting the engaging member to the third rod.

4. The footrest as claimed in claim 1, wherein a stopping member is connected to the second end of the pivotal shaft for helping holding the footrest part in position after adjustment of the footrest part; the stopping member including:

a fixed plate securely joined to the pivotal shaft;

a ratchet positioned next to the fixed plate and around the pivotal shaft; the ratchet being angularly displaceable relative to the pivotal shaft; the ratchet being positioned such that ratchet teeth thereof are in a direction opposite to that of the ratchet teeth of the detaining member;

an engaging bar pivoted to the frame for engagement with the ratchet;

an elastic element joined to the frame and the engaging bar at two ends thereof for biasing the engaging bar to an engaging position where the bar engages the ratchet;

a lining positioned next to the ratchet;

a separating plate positioned next to the lining and angularly displaceable together with the pivotal shaft;

an adjusting nut positioned on an outward side of the separating plate and screwed onto a threaded section of the pivotal shaft; and an elastic element for biasing the separating plate, the lining, and the ratchet towards the fixed plate so as to make the lining and the ratchet closely sandwiched between the fixed plate and the separating plate.

5. The footrest as claimed in claim 4, wherein each of the teeth of the ratchet of the stopping member has a steep side and a sloping side.

6. A footrest of a reclining chair, comprising a footrest part pivoted to a front portion of a seat of a reclining chair; and an adjusting mechanism joined to a frame of the chair, on which the seat is supported; the adjusting mechanism including:

a pivotal shaft passed through first and second lateral portions of a lower part of the frame respectively at first and second ends thereof;

two pairs of first and second connecting rods used for passing on movement of the pivotal shaft to the footrest part; the first rods being securely joined to the pivotal shaft; the second rods being each pivoted to a corresponding first rod, and pivoted to the footrest at two ends; the footrest part being movable between a completely stretched position and a retreated one by means of causing rotation of the pivotal shaft to displace the first and the second connecting rods;

a third connecting rod pivoted on a first end of the pivotal shaft;

a detaining member secured to the first lateral portion of the frame with the first end of the pivotal shaft being passed through a hole thereof; the detaining member having a plurality of ratchet teeth on an edge;

an engaging member pivoted on the third rod for releasable engagement with the ratchet teeth of the detaining member; the engaging member having an engaging portion, and a rod-shaped pressed portion;

a first elastic element joined to the third rod, and the engaging portion of the engaging member at two ends thereof for making the engaging member biased to such a position as to engage the detaining member;

a first control for displacing the footrest part with; the first control including a pedal portion, and a flat portion securely joined to the pedal portion; the flat portion being joined to the first end of the pivotal shaft such that the first control is angularly displaceable together with the pivotal shaft; the flat portion having a pivotal hole thereon, and two stopping posts located apart on an inward side thereof;

a second control made in a form of a pedal for displacing the footrest part with; the second control having an elongated flat portion positioned between the detaining member and the first control plus between the stopping posts of the first control; the elongated flat portion having an up-facing notch, and a pivotal portion; the second control being pivoted to the pivotal hole of the first control at the pivotal portion thereof;

a second elastic element joined to the flat portion of the first control, and the second control member at two ends thereof for biasing the second control in such a way that the up-facing notch is away from the rod-shaped pressed portion of the engaging member;

the ratchet teeth of the detaining member being in such a direction that the engaging member won't engage them when the pedal portion of the first control is being depressed; an edge of the notch of the second control being going to be pressed against the rod-shaped pressed portion of the engaging member to make the engaging member disengage the ratchet teeth when the second control is being depressed, and angularly displaced; and a stopping member joined to the second end of the pivotal shaft for helping holding the footrest part in position after adjustment of the footrest part; the stopping member including:

(1) a fixed plate securely joined to the pivotal shaft;

(2) a ratchet positioned next to the fixed plate and around the pivotal shaft; the ratchet being angularly displaceable relative to the pivotal shaft; the ratchet being positioned such that ratchet teeth thereof are in a direction opposite to that of the ratchet teeth of the detaining member;

(3) an engaging bar pivoted to the frame for engagement with the ratchet;

(4) an elastic element joined to the frame and the engaging bar at two ends thereof for biasing the engaging bar to an engaging position where the bar engages the ratchet;

(5) a lining positioned next to the ratchet;

(6) a separating plate positioned next to the lining and angularly displaceable together with the pivotal shaft;

(7) an adjusting nut on an outward side of the separating plate and screwed onto a threaded section of the pivotal shaft; and (8) an elastic element for making the lining and the ratchet closely sandwiched between the fixed plate and the separating plate;

thus allowing the footrest part to be angularly displaced to a stretched position by depressing the pedal portion of the first control, and allowing the footrest part to be moved towards a retreated position by means of depressing the second control to angularly displace same.

* * * * *